US005758954A

United States Patent [19]

Holten et al.

[11] Patent Number: 5,758,954

[45] Date of Patent: Jun. 2, 1998

[54] LUMINAIRE

[75] Inventors: Petrus A.J. Holten, Aalten, Netherlands; Corinne Lac, Nevers, France

[73] Assignee: U.S. Philips Corporation, New York, N.Y.

[21] Appl. No.: 601,141

[22] Filed: Feb. 13, 1996

[30] Foreign Application Priority Data

Feb. 14, 1995 [EP] European Pat. Off. ..... 95200347

[51] Int. Cl.[6] ..... F21V 11/06

[52] U.S. Cl. ..... 362/291; 362/290; 362/342; 362/354; 362/147

[58] Field of Search ..... 362/298, 301, 362/303, 290, 291, 346, 347, 349, 342, 343, 297, 147

[56] References Cited

U.S. PATENT DOCUMENTS

| | | | |
|---|---|---|---|
| 4,494,175 | 1/1985 | Gawad et al. | 362/291 |
| 4,539,628 | 9/1985 | Bartenbach | 362/291 |
| 4,621,309 | 11/1986 | Grawe et al. | 362/291 |
| 4,888,668 | 12/1989 | Roll | 362/217 |
| 5,008,791 | 4/1991 | Caferro | 362/342 |
| 5,448,462 | 9/1995 | Moran, III | 362/298 |
| 5,528,478 | 6/1996 | Degelmann | 362/290 |

FOREIGN PATENT DOCUMENTS

| | | |
|---|---|---|
| 0138747B1 | 1/1988 | European Pat. Off. . |
| 0271150A1 | 6/1988 | European Pat. Off. . |
| 0435394B1 | 12/1994 | European Pat. Off. . |
| 065076 | 7/1981 | Germany . |
| 3014365A1 | 10/1981 | Germany . |
| 3112210A1 | 10/1982 | Germany . |

*Primary Examiner*—Thomas M. Sember
*Attorney, Agent, or Firm*—Walter M. Egbert

[57] ABSTRACT

A luminaire has a housing with a light emission window (2), a tubular lamp supported in the housing facing the window (2) and having a center line extending in a plane P perpendicular to the window (2), side reflectors (5), and three-dimensional lamellae (10) which each have an outer edge (11) and a pair of inner edges (12). The outer edge of each lamellae is concave in a direction transverse to the window. The luminaire thus provides an optimized cut-off angle, screening light which would otherwise be dazzling but permitting non-dazzling light to pass. Each of the lamellae has a concave curvature in a direction parallel to the plane P but which flattens out going from plane P towards the side-reflectors (5). That enlarges the aperture through which light emanates and makes the illumination provided by the luminaire more uniform.

16 Claims, 8 Drawing Sheets

LUMINAIRE

BACKGROUND OF THE INVENTION

1. Field of the Invention

The invention relates to a luminaire comprising:

a housing provided with a light emission window;

means for supporting a tubular electric lamp with its longitudinal axis in a plane P which is transverse to the light emission window the lamp being, alongside said light emission window;

concave side reflectors positioned opposite one another at several locations along plane P and each having an outer edge adjacent the light emission window and in a plane Q; and three-dimensional lamellae transverse to the plane P and transverse to the light emission window. Each lamellar has an outer edge in the light emission window and a pair of inner edges inside the housing, and each has a respective deflection surface between the outer edge and each of the inner edges which has a concave curvature parallel to plane P. The outer edge is also concave and has a direction crossing plane P which is substantially parallel to plane Q.

2. Description of the Related Art

Such a luminaire is known, for example, from EP-B-0 138 747.

The side reflectors concentrate the light generated by the lamp into a beam, possibly in conjunction with a reflector opposite the light emission window, but they also provide a screening. As a result of this, the lamp cannot be observed in planes perpendicular to plane P, the so-called C0 planes, at an angle to the plane Q smaller than a chosen angle β. The angle β is at least 30° when plane Q is in a horizontal position, for the illumination of spaces in which picture screens are positioned in order to avoid reflections on these screens.

The object of the lamellae is to achieve that the lamp cannot be observed at angles smaller than angle β also in plane P, which is called plane C90 in lighting technology. They intercept light directed at smaller angles and reflect it, deflect it, and/or scatter it. The side reflectors and the lamellae have a similar function in the C planes between C0 and C90.

Since there is no material which reflects incident light for 100% of the incident light for because absorption always occurs, lamellae provide not only screening, and thus comfort for the user of the space illuminated by the luminaire, but also cause light losses.

In the known luminaire mentioned above, the deflection surfaces extend to a greater distance away from plane Q adjacent the side reflectors than in the centres of the lamellae. The distance between the inner edges of a lamella accordingly increases in the direction towards the side reflectors. As a result, the openings bounded by the side reflectors and the lamellae through which light can pass to the exterior are barrel-shaped and small compared with those in luminaires having conventional lamellae which have parallel outer and inner edges. The lamellae intercept much light as a result, the more so as the lamellae are open between their inner edges and light incident between these edges is substantially lost, especially if the lamellae are black there. This is a major disadvantage for a luminaire. Even if the lamellae were to extend to the same distance away from plane Q adjacent the side reflectors and in the centre, said openings would still be barrel-shaped owing to the concave outer edge, and the luminaire would have the above disadvantage.

According to the cited patent document, the shape of the lamellae has the object of providing not only a screening in longitudinal and transverse directions, but also a reliable screening in diagonal direction. The efficiency of the luminaire is said to be increased, according to the cited document, when the outer edges of the lamellae are concave.

Another luminaire is known from EP-B-0 435 394 in which the lamellae each have a straight outer edge in the light emission window and an inner edge parallel thereto in the housing, as is the case in many other known luminaires. The lamellae essentially have a cross-sectional shape of an isosceles triangle with the apex in the light emission window. The legs of the triangle are concavely curved, for example parabolically, in order to deflect light incident at an angle greater than or equal to angle β. Alternatively, the legs may be straight. The lamellae have a constant cross-section parallel to plane P over their entire length.

The lamellae of this latter luminaire are folded from metal tape, the seam lying in the apex. This has the advantage over a lamella folded from tape with a seam elsewhere that the outer edge is much sharper, having a smaller dimension in plane P and parallel thereto than if the lamella were to have a fold there. For a given shape and dimension of the main surfaces of the lamella, a sharp outer edge implies a narrower inner surface, i.e. a shorter base of the triangular cross-sections, than in the case of a lamella folded on the outer edge. The free passage opening for light is accordingly greater both in the light emission window at the outer edges of the lamellae and at the inner edges of the lamellae.

Tongues may have been detached from the surface between the inner edges of these lamellae, i.e. from the inner surface, bent from said surface. It is prevented hereby that, after reflection on that surface, bright spots are formed on the side reflectors which can be observed within the angle β.

Lamellae are known from DE-A-30 14 365 which have a structure with a sawtooth profile between their inner edges, for example with a Fresnel geometry, for this purpose, i.e. for the prevention of bright spots.

A luminaire is known from EP-A-0 271 150 where the lamellae, which are V-shaped in cross-section and are straight at the outer edges, each have a lid which is concave transverse to plane P. The lid ensures on the one hand that no light can be lost which would otherwise be incident in the open lamellae, and on the other hand by its concave shape that no undesirable bright spots are formed in the side reflectors which can be observed from within the angle β.

A luminaire having lamellae which for this same purpose ascend in a direction to the side reflectors, with a concave, reflecting surface rising towards the side reflectors in between the inner edges, was already known from DE-E-31 12 210. The rising reflecting surface may here be a portion of a separate inner component of the lamella.

A luminaire was already known from DE-U-81 06 507, too, where the lamellae each comprise a strip which for this same purpose is concave transverse to plane P, which lies recessed between the inner edges, which is parallel to the inner edges in a central zone, and which extends from this zone upwards to the side reflectors.

SUMMARY OF THE INVENTION

It is an object of the invention to provide a luminaire of the kind described in the opening paragraph in which a reduction of the generated luminous flux owing to the presence of the lamellae is counteracted.

According to the invention, this object is achieved in that the concave curvature of the deflection surfaces becomes less pronounced towards the side reflectors.

The invention is based on the recognition that the lamellae of the known kinds of the luminaire described in the opening paragraph have a larger light-intercepting surface area than is necessary for realizing the desired screening. This will be explained also with reference to the diagrammatic FIGS. 1 to 4.

In FIG. 1, the outer edge 6 of the side reflectors 5' defines the smallest angle β to plane Q at which the tubular lamp 4 can be observed in the C0 plane shown of the luminaire pictured in cross-section. This cross-section is parallel to a lamella 10' having an outer edge 11 at the outer side of the luminaire and an inner edge 12 inside the luminaire.

FIG. 2 shows the same luminaire seen along arrow II in FIG. 1, and FIGS. 3 and 4 show the luminaire taken on the lines III and IV in FIG. 2, i.e. a C45 plane and the C90 plane, respectively.

The interspacing between adjoining lamellae 10'and the height thereof, i.e. the distance between their outer and inner edges, have been so chosen that the lamellae in FIG. 3 provide the same screening as the side reflectors shown in FIG. 1.

It is apparent from FIG. 2 that the lamellae are closer together in the C90 plane of FIG. 4 than in the C45 plane of FIG. 3. The cut-off angle β in FIG. 4 is accordingly greater than angle β in FIG. 1 and FIG. 3. This means that the lamellae in the C90 plane cut off more light than is cut off in other planes. Too much light is cut off also in planes between C90 and C45, albeit to a decreasing degree moving from C90 to C45. Light is lost unnecessarily in this way owing to incomplete reflection by the lamellae.

It is apparent from this that in plane P through the lamp the outer edges 11 of the lamellae must be farther removed from the plane Q defined by the outer edges of the side reflectors than in locations farther away from plane P. If the standard with which the luminaire is to comply requires the same angle β in all C-planes, the outer edges will have a gradual, concave gradient.

It is clear from FIG. 2 that the entire outer edge is of importance for the screening action of the lamellae and only a narrow, central portion of the inner edge. The inward displacement of the inner edges of the lamellae over comparatively wide areas which adjoin the side reflectors has no relevance at all to the cut-off angle β. Neither could the object as defined be achieved through an adaptation of the shape of the central portion of the inner edge because the central portion is of importance for very many C-planes, in each of which planes a shape specially attuned to that plane would be necessary. A shape of the inner edge which is accurately attuned to each C-plane thus cannot be realized, also because of the comparatively small distance from the inner edges to the lamp and the concomitant very narrow tolerance limits. The above demonstrates that, in contrast to what is stated in the above cited patent document EP-B-0 138 747, the barrel shape of the opening bounded by the side reflectors and adjoining lamellae, through which the light can issue to the exterior, is of no importance for screening of the lamp. Similarly, the diagonal b—b'in FIG. 1 of said patent document is irrelevant to this screening.

The invention is further based on the recognition that it is favorable for the deflection of light if the deflection surfaces, in contrast to the deflection surfaces of the lamellae of the known luminaire mentioned in the opening paragraph and of conventional luminaires, have a curvature which becomes less pronounced going towards the side reflectors. This is advantageous for various reasons. The light incident on the deflection surfaces of the lamellae adjacent the side reflectors in the main has an angle of incidence which requires comparatively little deflection in planes perpendicular to plane Q. The weaker curvature in situ provides for this. Furthermore, a progressively weaker curvature parallel to plane P renders the concave deflection surfaces also less concave parallel to plane Q, so that the light is better spread in directions transverse to plane P. The luminaire then provides a more homogeneous illumination of a space lit with several parallel luminaires. It is in addition achieved that the distance between the inner edges of the lamella remains comparatively small adjacent the side reflectors. The lamella remains comparatively thin there. It is avoided thereby that the lamella will intercept comparatively much light between its inner edges and that the passage opening for light becomes comparatively small near the side reflectors. It should be borne in mind here that the lamella in general has a greater distance between the outer edge and the inner edges adjacent the side reflectors than in plane P owing to its concave outer edge.

In a favorable modification, the lamella has substantially parallel inner edges owing to the fact that the curvature becomes weaker parallel to plane P.

In a further favorable modification, the inner edges of a lamella are concave towards one another. The lamella itself is then barrel-shaped in projection in plane Q. This modification has an enhanced light-spreading effect.

Preferably, the lamellae are at least substantially closed by means of a reflecting inner surface between their inner edges in order to counteract the loss of light which would enter hollow lamellae.

It is favorable when the inner surfaces of the lamellae with inner edges parallel to plane Q are profiled and have, for example, a sawtooth relief or a Fresnel relief, or are provided with tags pressed from said surfaces. It can be prevented thereby that light incident on the material at the inner edge or on the inner surface is reflected to locations on the side reflector where it can be observed in the form of bright spots from positions within angle β.

Alternatively, it is favorable for the same purpose if the lamellae have inner edges which rise towards the side reflectors.

In a modification thereof, it is favorable if the deflection surfaces are limited by a folding line, for example parallel to plane Q. The folding line may be substantially tangent to the inner edge in plane P. This folding line may be a straight line, but alternatively it may follow a curved, for example convex path relative to plane Q. This line may then again be a straight line in projection in plane Q. The surfaces of the lamella between the folding lines and the inner edges, the connecting surfaces, may be concave or plane in plane P and parallel thereto. The connecting surfaces of a lamella may diverge away from the folding lines. It is favorable when the connecting surfaces are plane and mutually parallel. Connecting surfaces which converge from the folding lines towards the inner edges were found to be unfavorable in general because they reflect incident light insufficiently, or not at all, in the direction of the light emission window.

If the folding lines are straight lines or form straight lines in projection in plane Q, the projection of the inner surface of each lamella in plane Q is a rectangle. Its surface area is minimized then when the connecting surfaces of the lamellae are mutually parallel between the folding line and the upper edge.

Connecting surfaces which are parallel in cross-sections parallel to plane P are favorable for minimizing the surface area of the projection of the lamella in plane Q, also when the inner edges of each lamella are concave towards one another.

The concave outer edges of the lamellae may have the direct result that the outer edges of the lamellae are less sharp, i.e. thicker in plane P than adjacent the side reflectors. This is caused by the fact that the lamellae start adjacent the side reflectors immediately at plane Q, but in plane P at a distance from plane Q. It is admissible for the light distribution provided by the luminaire, however, when the outer edge of each lamella is substantially of the same thickness all over its length, so that the lamellae are concavely curved in planes parallel to plane Q.

The lamellae may be made, for example, from synthetic resin or bent sheet metal, for example aluminum sheeting and may be painted preferably with glossy paint, or may preferably have a metallic, preferably mirroring surface, for example of anodized aluminum, or a mirroring foil coating. Alternatively, the metallic surface may be obtained through metallization, for example metal vapour deposition. The lamellae may be concavely curved at their deflection surfaces, for example parabolically, parallel to plane P, as is the case in conventional luminaires.

In a special embodiment of the luminaire, the lamellae are each manufactured from one piece of sheet material, for example aluminum, whether or not with a mirroring skin or coating. The sheet is then cut into shape, for example stamped and provided with a window, in the case of lamellae with connecting surfaces. The sheet is subsequently folded and curved so that lateral edges of the sheet come to lie laterally against one another, forming the outer edge of the lamella. The boundaries of a window are then present in the inner surface, preferably forming an at least substantially closed seam there. The lamella is an integral whole owing to bridges situated adjacent the side reflectors in the inner surface, which were maintained in the sheet during making of the window therein.

It is favorable for achieving an equal screening in all C-planes if the lamellae are concave at their outer edges substantially in accordance with a goniometric function:

$$h_p = h_o / \cos \alpha,$$

where

- $h_p$ is the distance from a point p of the outer edge 11 to a plane Q' parallel to plane Q, through the points of intersection s of the inner edges 12 and plane P (see FIGS. 1, 5);
- $h_o$ is the distance from plane Q to plane Q '(see FIG. 5);
- $\alpha$ is the angle enclosed by a plane R through a point p and through the point s of the adjacent inner edge 12 of the adjacent lamella and plane P (see FIG. 2).

This function is closely approximated by a circular arc.

There are also standards for luminaires, however, which require the same, strong screening effect, a comparatively great angle $\beta$, in plane P and perpendicular to plane P but a lesser screening effect in planes in-between. To comply with such a standard, the outer edge may have a shape different from that defined by the above equation. The concave outer edge may then have a straight central portion and portions, for example straight portions, extending obliquely from this central portion towards the side reflectors. It is alternatively possible for a straight or concave central portion which has a width, for example, of the order of the diameter of a lamp to be accommodated concave portions extending towards the side reflectors and offset in the direction of the inner edges to merge into.

The side reflectors may form together with the lamellae a louver which may or may not be removable. A main reflector may be present in the housing opposite the light emission window. Alternatively, the housing itself may act as the main reflector. It is also possible for the housing to have a luminous window opposite the light emission window, through which light can emerge for indirect lighting, for example in the case of a suspended luminaire or a luminaire included in a luminous box. Such a luminous box, incorporated in a false ceiling, then gives a framework of medium brightness around a bright light emission window in a ceiling of low brightness. If the luminaire has a luminous window, the latter may be closed off with a light-transmitting, possibly light-spreading, reflecting, or scattering plate. Embodiments of the luminaire according to the invention may also be used, however, for incorporation in a ceiling or fastening against a ceiling.

The luminaire according to the invention may be suitable for accommodating several lamps next to one another, for example in that units comprising side reflectors, lamellae, and means for holding a lamp are arranged next to one another in a housing. A light beam formed by the luminaire or by a unit thereof may be symmetrical relative to plane P, for example when the side reflectors are identical and have a symmetrical arrangement, or it may be asymmetrical.

BRIEF DESCRIPTION OF THE DRAWINGS

Embodiments of the luminaire according to the invention are shown in the drawings, in which

In FIG. 5, showing a first the luminaire has a housing provided with a light emission window 2. Means 3 are present for holding a tubular electric lamp 4 alongside the light emission window in a plane P which is transverse to said window. In the Figure, the lamp is a low-pressure mercury discharge lamp coated with a luminescent material. Concave side reflectors 5 are arranged opposite one another with respect to plane P, each having an outer edge 6 adjacent the light emission window in a plane Q. Three-dimensional lamellae 10 with outer edges 11 in the light emission window and inner edges 12 inside the housing 1 are arranged transverse to the plane P and transverse to the window 2. They each have a respective deflection surface between the outer edge 11 and the inner edges 12 which has a concave curvature parallel to plane P. The outer edge 11 is concave and has, in plane P, a direction which is substantially parallel to plane Q. The luminaire shown is a suspension luminaire, having a light-transmitting cover plate 7 with a profile 7'with a light-deflecting effect above the lamp 4. The side reflectors each have a wing 5*a* diverging away from plane P in upward direction high in the luminaire so as to form a light beam for indirect lighting.

Figure 1:
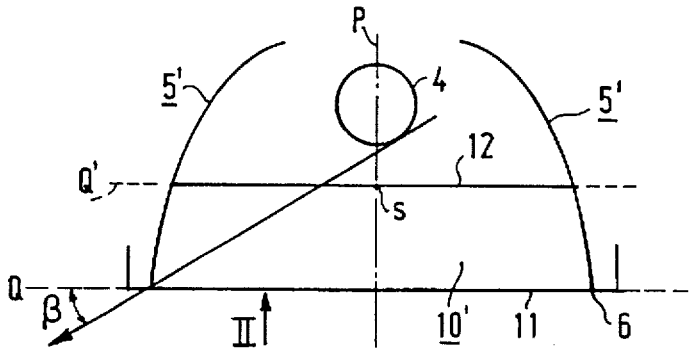
FIG. 1 is a diagrammatic cross-section of a conventional luminaire.
Figure 2:
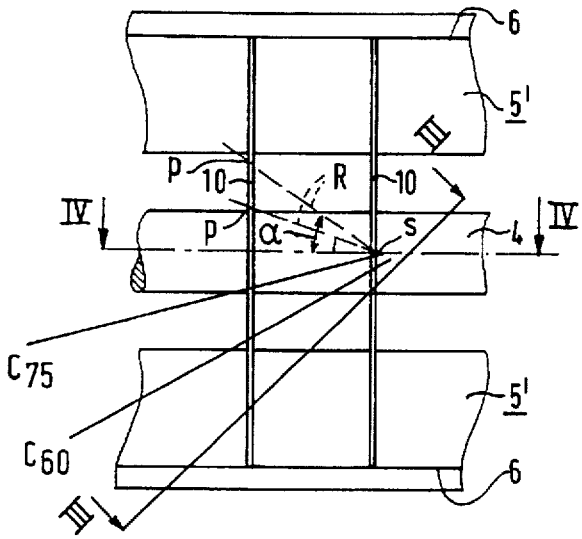
FIG. 2 shows the luminaire of FIG. 1 seen along II.
Figure 3:
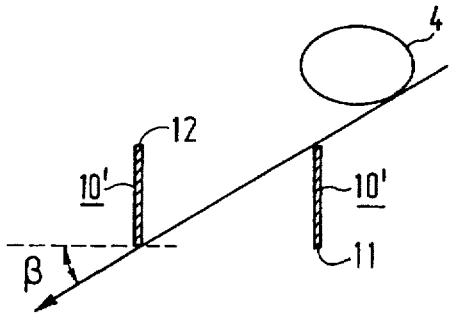
FIGS. 3, 4 show the luminaire taken on the lines III, IV in FIG. 2, respectively.
Figure 4:
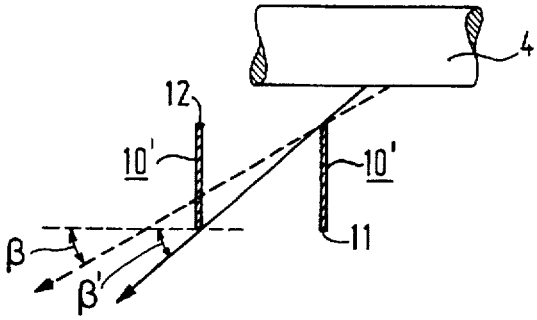

In the Figure, the lamellae 10 are concave at their outer edges 11 approximately in accordance with a goniometric function: $h_{p=h_o}/\cos\alpha$, where:

$h_p$ is the distance from a point p of the outer edge 11 to a plane Q'parallel to plane Q through the points of intersection s of the inner edges 12 and plane P;

$h_o$ is the distance from plane Q to plane Q';

$\alpha$ is the angle enclosed by a plane R through a point p and through the point s of the adjacent inner edge 12 of the adjacent lamella and plane P.

In the Figure, the outer edge 11 of each lamella 10 is concave in accordance with a circular arc.

The concave curvature of the deflection surface of each lamella, flattens out, becoming less pronounced going from the center in plane P towards the side reflectors 5. The lamellae are shown in front elevation so that only a contour is visible. They have inner edges 12 which rise towards the side reflectors 5.

Figure 6:
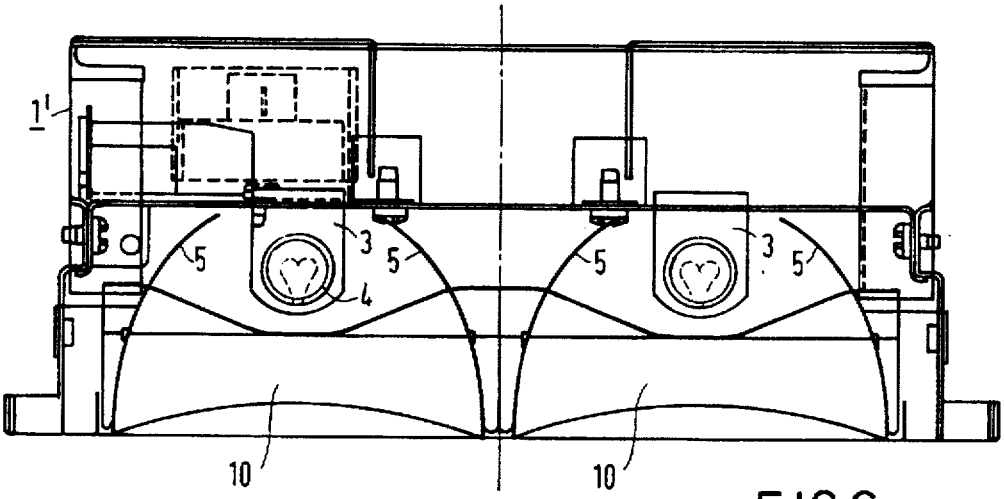
FIG. 6 is a similar cross-section of a second embodiment.

In FIG. 6, the luminaire is designed for incorporation in a false ceiling. The housing 1' has two units of side reflectors 5 placed next to one another, means 3 for holding an electric lamp 4, and lamellae 10.

Figure 7:
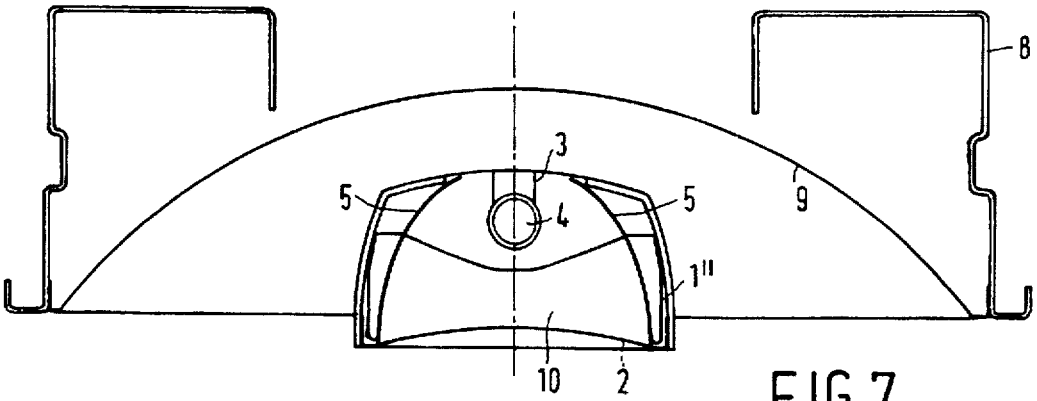
FIG. 7 is a similar cross-section of a third embodiment.
Figure 8:
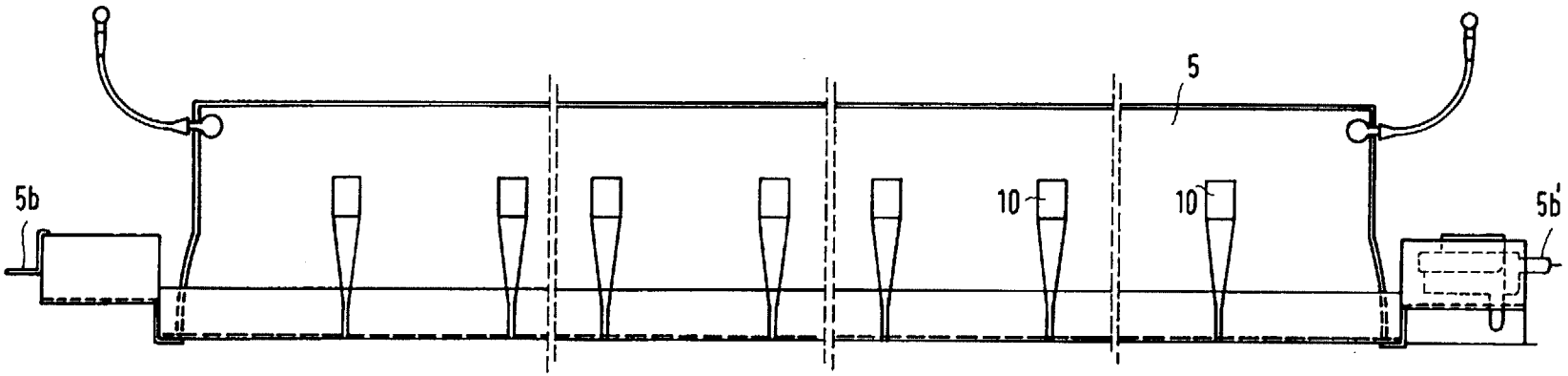
FIG. 8 is a side elevation of a side reflector for use in FIGS. 6 and 7.

In FIG. 7, a luminaire with the components 1", 3, 4, 5, 10 is accommodated in a luminous box 8 with a reflector 9 therein, designed for mounting in a false ceiling. The reflector 9 surrounds the housing 1" at a distance at four sides. During operation, the light emission window has a comparatively high brightness, the reflector a medium brightness, and the relevant ceiling itself a low brightness. Brightness contrasts in the ceiling are toned down thereby.

In the side elevation of the side reflector 5 of FIG. 6, a number of three-dimensional lamellae are visible which project each with an end portion through said reflector to the exterior and are fastened to this reflector. Together with a second side reflector, positioned behind the visible one in the Figure, the lamellae form a removable louver or grid which has means 5*b*, 5*b*' for coupling it to mutually opposed walls of a housing.

Corresponding components have been given the same reference numerals each time in the ensuing description of FIGS. 9 to 14, also where modified versions are described.

Figure 5:
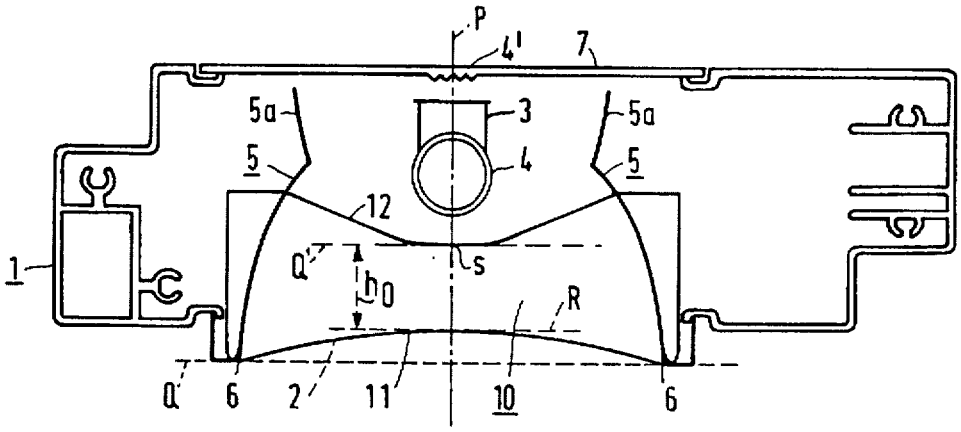
FIG. 5 is a cross-section of a first embodiment of the luminaire according to the invention, taken parallel to a lamella.
Figure 9:
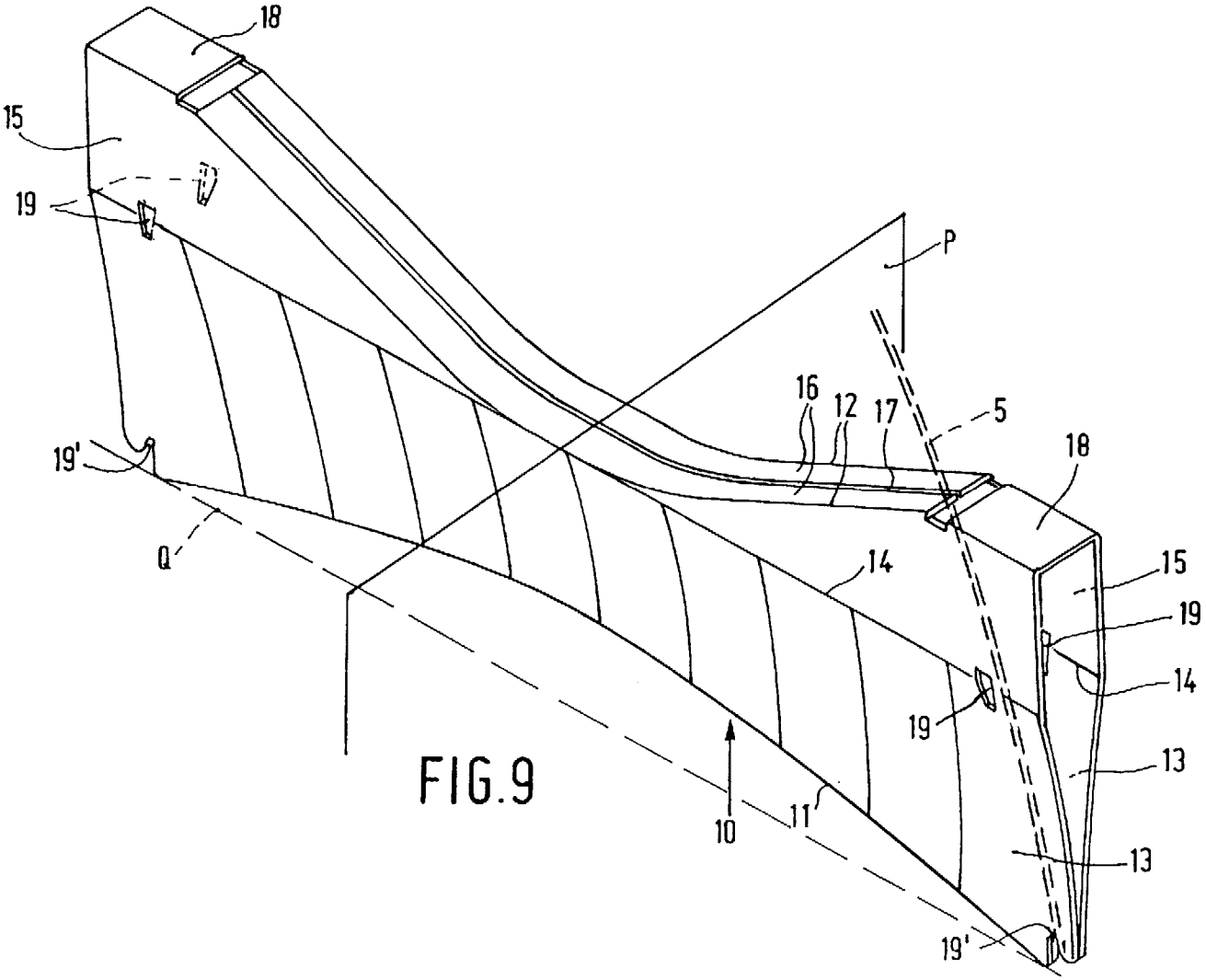
FIG. 9 shows an embodiment of a lamella in perspective view.

The lamella 10 of FIG. 9, which is used inter alia in FIG. 5, has deflection surfaces 13 which diverge away from one another from their outer edges 11 and which are concavely curved in directions parallel to plane P. This is indicated in the Figure with curved lines which trace the shape, but which are in actual fact not present in the pictured lamella. The outer edge 11 of the lamella is of the same thickness over its entire length, i.e. twice the thickness of the sheet material from which the lamella was formed. The curvature of the deflection surfaces 13 becomes weaker parallel to plane P going from plane P to the side reflectors 5.

The lamella 10 has inner edges 12 which become higher towards the side reflectors 5.

The deflection surfaces 13 of the lamella 10 are bounded adjacent the inner edges 12 thereof by a folding line 14 which is parallel to plane Q in the Figure. The folding line 14 is tangent to the inner edge 12 in plane P, and is a straight line in the lamella of the Figure.

Connecting surfaces 15, which are mutually parallel in the Figure, are present between the folding lines 14 and the inner edges 12 of the lamella. It is also possible, however, for the connecting surfaces to converge starting from from the folding lines, especially in a luminaire having a luminous window opposite a light emission window, so that light is thrown towards the luminous window upon reflection.

The lamella was folded and bent from one piece 20 of sheet material (see also FIG. 15) whose lateral edges 21 lie side by side against one another in the outer edge 11 of the lamella 10.

The lamella has an inner surface 16 with a seam 17 which is at least substantially closed between the inner edges 12. The inner edges 12 are parallel. The lamella as openings 19 and recesses 19' in order to be coupled to side reflectors 5.

Figure 10:
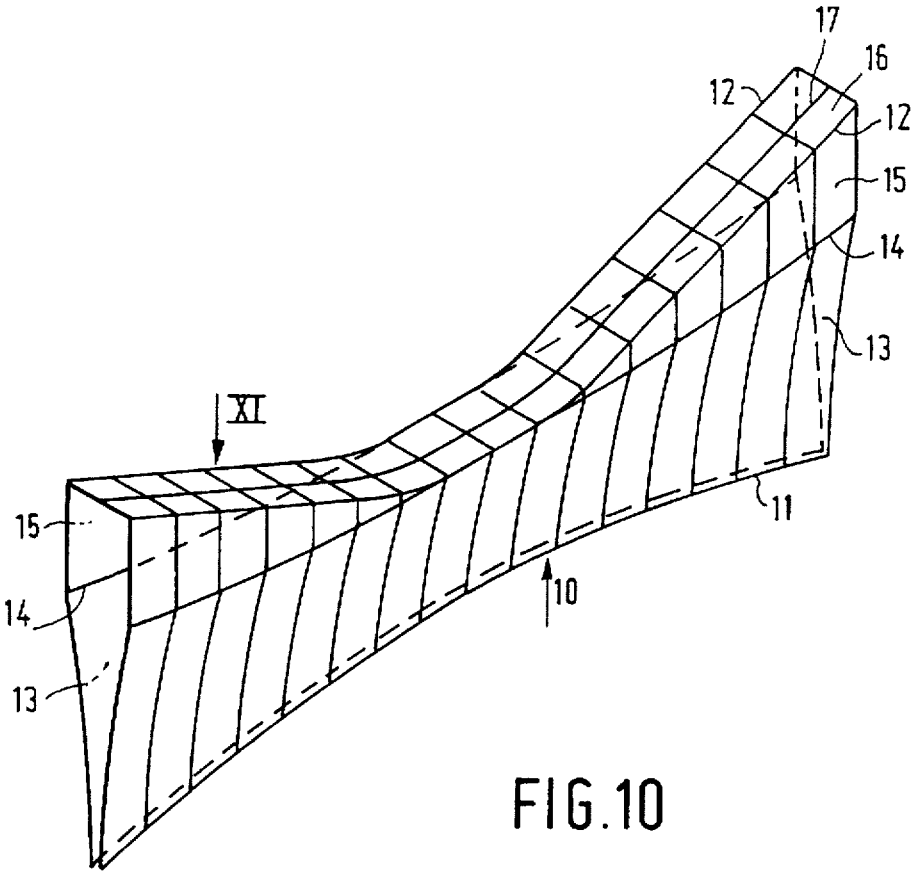
FIG. 10 shows a second embodiment of a lamella in perspective view.
Figure 11:
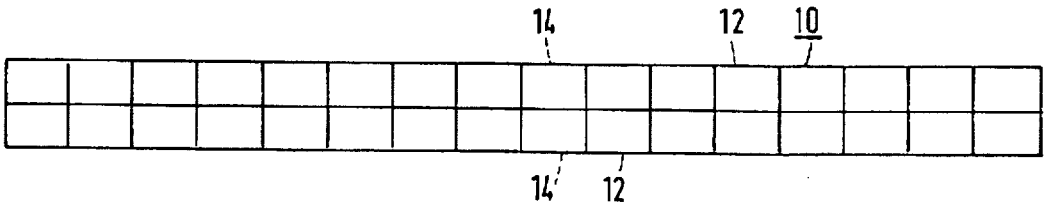
FIG. 11 shows the lamella of FIG. 10 taken on the line XI.

In FIGS. 10 and 11, cross-sections through the lamella 10 parallel to plane are again indicated with lines which in actual fact are not present in the lamella of the figures. The folding lines 14 are convex towards plane Q (see FIG. 5), but in projection in this plane they are straight lines (see FIG. 11). This means that the curvature of the deflection surfaces 13 decreases more strongly towards the side reflectors than is the case in FIG. 9. The connecting surfaces 15 are mutually parallel. The inner surface 16 is a rectangle when projected in plane Q.

Figure 12:
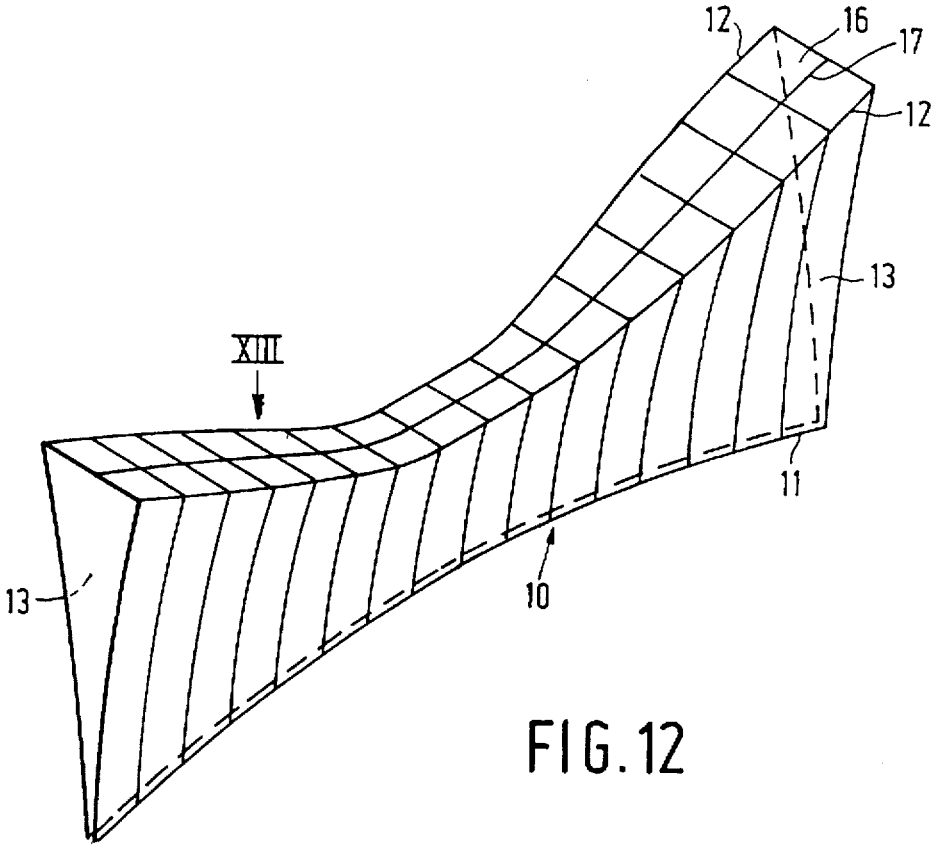
FIG. 12 shows a third embodiment of a lamella in perspective view.
Figure 13:
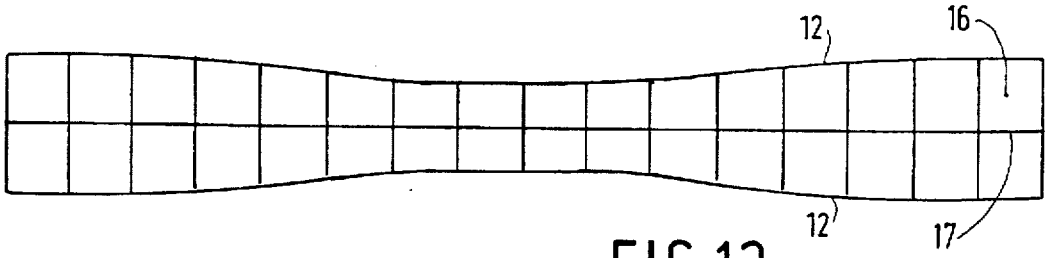
FIG. 13 shows the lamella of FIG. 12 taken on the line XIII.

The lamella 10 of FIGS. 12 and 13 has no folding lines but a curvature of the deflection surfaces 13 which decreases gradually from plane P. The inner surface projected in plane Q is not a rectangle, but widens from the centre less than if the curvature of the deflection surfaces were uniform over the length of the lamella.

Figure 14:
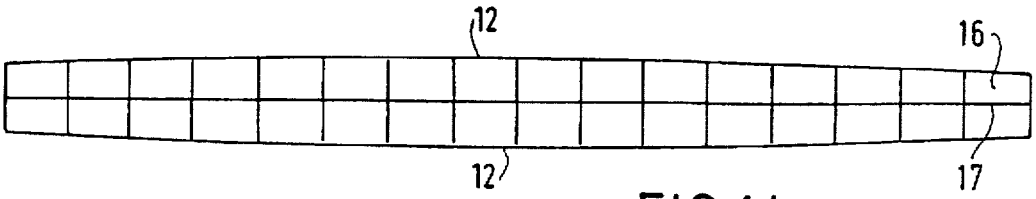
FIG. 14 shows a fourth embodiment of a lamella in the same way as in FIG. 13.

The lamella of FIG. 14 has deflection surfaces which become less curved away from plane P, from its centre, to such an extent that the inner surface 16 of the lamella is bounded by two inner edges which are concave towards one another. The inner surface of the lamella projected in plane Q is barrel-shaped. The lamella has a comparatively strong spreading influence on the light reflected thereby.

Figure 15:
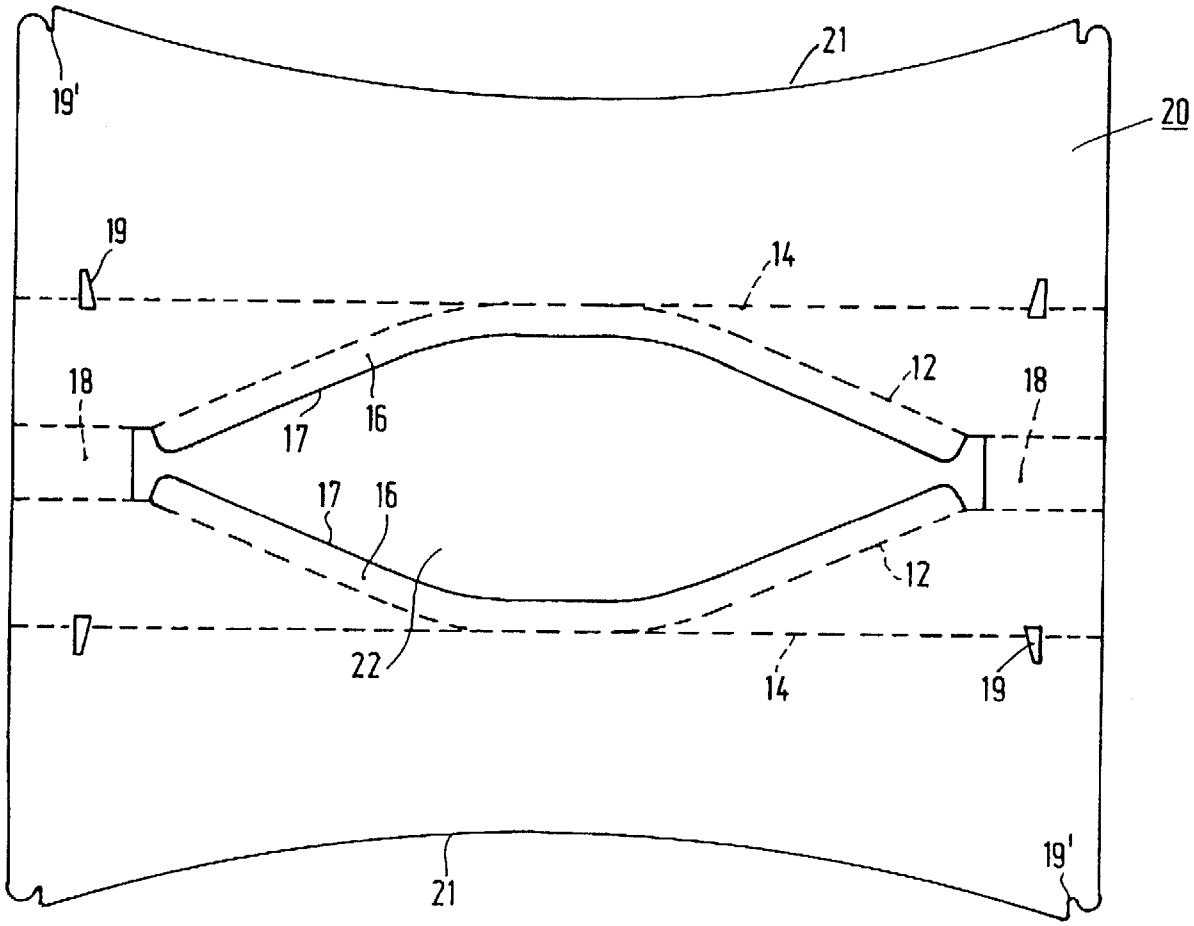
FIG. 15 shows a preshaped blank tape for manufacturing the lamella of FIG. 9.

In FIG. 15, the piece 20 of sheet material, for example of anodized aluminum, was cut into a blank such that the lamella of FIG. 9 can be formed therefrom through bending and folding. The concave lateral edges 21 then will lie side by side so as to form the outer edge 11 of the lamella. Folding lines 14 will be made on straight broken lines. Curved broken lines will form the inner edges 12. Curves bounding a window 22 will form an at least substantially closed seam 17 in the finished lamella. Material has been spared in the piece 20, connecting the halves of the piece and forming bridges 18 in the lamella which will lie outside the side reflectors.

Figure 16:
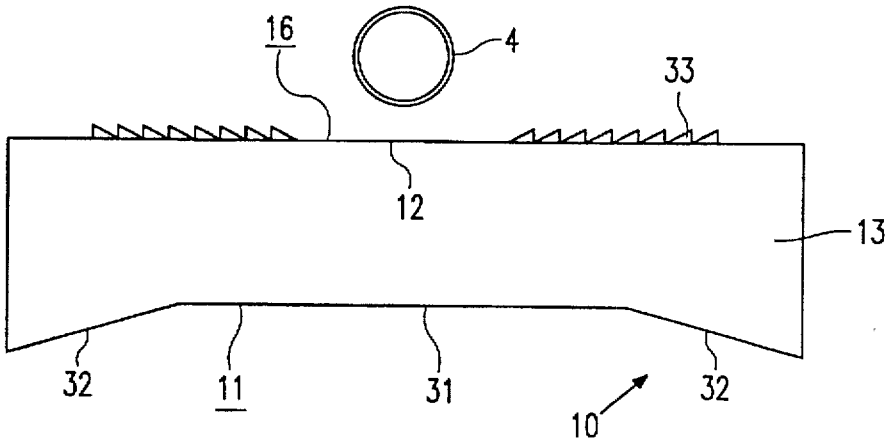
FIG. 16 shows another lamella, viewed as in FIG. 5.

In FIG. 16, the lamella 10 has a concave outer edge 11 with a straight central portion 31 and portions 32 which extend obliquely away therefrom towards the side reflectors and which are concave in the Figure. The lamella provides a comparatively great cut-off angle $\beta$, in the centre and at its ends, in the area of the portions 32, and a smaller angle therebetween.

The lamella has an inner surface 16 provided with a relief 33, a sawtooth profile in the Figure, between the inner edges 12.

Figure 17:
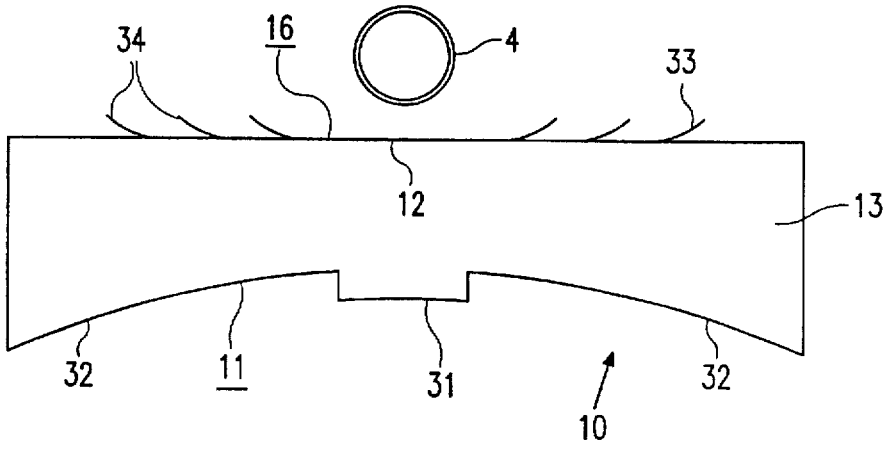
FIG. 17 shows a further lamella according to the invention in a similar elevation.

In FIG. 17, the concave outer edge 11 of the lamella 10 has a central portion 31 merging into concave portions 32 which extend towards the side reflectors 5 and are offset in the direction of the inner edges 12. The central portion 31 is concavely curved and has a width slightly greater than the diameter of the lamp 4. The screening provided by the lamella is of the same kind as that of FIG. 16.

The relief 33 of the lamella 10 comprises tongues 34 pressed from the inner surface 16.

We claim:

1. A luminaire comprising:

a housing (1) having a light emission window (2);

means (3) for supporting a tubular electric lamp with its longitudinal axis in a plane P which is transverse to the light emission window, the lamp being alongside said window;

concave side reflectors (5) positioned opposite each other with respect to several successive locations along said plane P, each reflector having an outer edge (6) adjacent the light emission window in a plane Q; and a plurality of three-dimensional lamellae (10) at successive positions transverse to said plane P and also transverse to the light emission window (2); each lamella having an outer edge (11) in the light emission window and two inner edges (12) inside the housing (1), and deflection surfaces (13) between the outer edge (11) and each of the inner edges (12); each of said deflection surfaces having a concave curvature in a direction parallel to said plane P, the outer edge (11) thereof being concave and directed so that crossing plane P it is substantially parallel to the plane Q;

characterized in that the concave curvature of the deflection surfaces (13) of each of the lamellae becomes less pronounced going towards each of the side reflectors (5).

2. A luminaire as claimed in claim 1; wherein that the lamellae are each folded and curved from one piece of sheet material, lateral edges (21) of which lie side by side against one another in the outer edge (11) of the lamella.

3. A luminaire as claimed in claim 1 or 2, wherein the lamellae have substantially parallel inner edges (12).

4. A luminaire as claimed in Claim 3 wherein an inner surface (16) provided with a relief (33) is present between the inner edges(12).

5. A luminaire as claimed in claim 4, wherein the relief (33) comprises tongues (34) which have been pressed from the inner surface (16). comprises tongues (34) which have been pressed from the inner surface (16).

6. A luminaire as claimed in claim 3, wherein the inner edges (12) rise towards the side reflectors (5), and an inner surface (16) is present between the inner edges (12).

7. A luminaire as claimed in claim 6, wherein the deflection surfaces (13) of the lamellae (10) are bounded adjacent the inner edges (12) thereof by a folding line (14).

8. A luminaire as claimed in claim 7, characterized in that the folding line (14) crosses plane substantially tangent to the inner edge (12).

9. A luminaire as claimed in claim 6, the inner surface (16) has a seam (17) between the inner edges (12).

10. A luminaire as claimed in claim 9, the seam (17) is at least substantially closed.

11. A luminaire as claimed in claim 3, wherein the lamellae have two inner edges (12) which rise towards the side reflectors (5) and an inner surface (16) which is present between said inner edges (12), the deflection surfaces (13) of each of the lamellae are bounded adjacent the inner edges (12) thereof by a folding line (14), and the folding line (14) is substantially a straight line as seen in projection in plane Q.

12. A luminaire as claimed in claim 7 or 11, wherein substantially parallel connecting surfaces (15), are present between the folding lines (14) and the inner edges (12) of each lamella.

13. A luminaire as claimed in claim 1 or 2 wherein certain portions of the inner edges (12) of a lamella are concave towards one another.

14. A luminaire as claimed in claim 1, 2 or 6, wherein the concave outer edge (11) of each lamella comprises a straight central portion (31) and portions (32) extending obliquely therefrom towards the side reflectors (5).

15. A luminaire as claimed in claim 1, 2, or 6, wherein the concave outer edge (11) of each lamella has a central portion (31) merging into portions (32) which extend towards the side reflectors (5) and are concave in 9 direction toward the inner edges (12).

16. A luminaire as claimed in claim 2, 6 or 1, wherein the outer edge (11) of each lamella is concave substantially in accordance with a goniometric function: $h_p = h_o / \cos \alpha$, where $h_p$ signifies distance from a point p on said outer edge (11) to a plane Q' which is parallel to said plane Q and passes through points of intersection s of the inner edges (12) of the lamella and plane P;

$h_o$ signifies distance from plane Q to plane Q'; and $\alpha$ a signifies an angle enclosed by plane P and a plane R through said point p and a point of intersection of an adjacent inner edge (12) of an adjacent lamella and plane P.

* * * * *